US010932510B2

(12) United States Patent
Rybak

(10) Patent No.: US 10,932,510 B2
(45) Date of Patent: Mar. 2, 2021

(54) CONVERTIBLE HEADWEAR

(71) Applicant: Miroslav Rybak, Putnam Valley, NY (US)

(72) Inventor: Miroslav Rybak, Putnam Valley, NY (US)

( * ) Notice: Subject to any disclaimer, the term of this patent is extended or adjusted under 35 U.S.C. 154(b) by 130 days.

(21) Appl. No.: 16/166,123

(22) Filed: Oct. 21, 2018

(65) Prior Publication Data

US 2019/0116905 A1 Apr. 25, 2019

Related U.S. Application Data

(60) Provisional application No. 62/575,372, filed on Oct. 21, 2017.

(51) Int. Cl.

| | |
|---|---|
| ***A42B 1/00*** | (2006.01) |
| ***A42B 1/006*** | (2021.01) |
| ***A41D 13/11*** | (2006.01) |
| ***A42B 1/206*** | (2021.01) |
| ***A42B 1/205*** | (2021.01) |
| ***A41D 15/04*** | (2006.01) |

(52) U.S. Cl.

CPC ..... *A42B 1/006* (2013.01); *A41D 13/1161* (2013.01); *A41D 15/04* (2013.01); *A42B 1/205* (2013.01); *A42B 1/206* (2013.01)

(58) Field of Classification Search

CPC ..... A42B 1/006; A42B 1/206; A42B 1/205; A41D 15/04; A41D 13/1161

See application file for complete search history.

(56) References Cited

U.S. PATENT DOCUMENTS 2,005,361 A * 6/1935 Rollins ..... A42B 1/066 2/195.1
2,089,995 A * 8/1937 Dobbs ..... A42B 1/066 2/207
2,859,448 A * 11/1958 Gaichel ..... A42B 1/066 2/202
4,300,240 A * 11/1981 Edwards ..... A41D 13/1161 2/206
5,035,006 A * 7/1991 Hetz ..... A41D 13/1161 128/206.19
5,048,128 A * 9/1991 Watson, Jr. ..... A42B 1/066 2/171
5,161,260 A * 11/1992 Reynolds ..... A42B 1/066 2/171
5,381,559 A * 1/1995 Wakefield, III ..... A42B 1/066 2/172

(Continued)

*Primary Examiner* — Khaled Annis

(74) *Attorney, Agent, or Firm* — Mestechkin Law Group P.C.

(57) ABSTRACT

A convertible headwear comprising a kerchief, a headband, and a visor, wherein the kerchief, the headband, and the visor are irremovable interconnected to form a hat that is convertible into a face mask, wherein the headband comprises one terminal end and one other terminal end, wherein each of the one terminal end and the one other terminal end comprises at least one fastening element, wherein the at least one fastening element of the first terminal end is configured to removably connect to the at least one fastening element of the one other terminal end, wherein the visor is irremovably connected to the kerchief, and wherein the headband is irremovably connected to the kerchief.

12 Claims, 5 Drawing Sheets

(56) References Cited

U.S. PATENT DOCUMENTS 5,493,732 A * 2/1996 Fawkes ..... A42B 1/066 2/195.1
5,542,127 A * 8/1996 Bezanis ..... A42B 1/066 2/172
D376,681 S * 12/1996 Riesenman ..... D2/866
5,594,956 A * 1/1997 Barrientos ..... A42B 1/041 2/171
5,685,016 A * 11/1997 Douglas ..... A41D 23/00 2/171
5,790,986 A * 8/1998 Hall ..... A42B 1/066 2/172
D474,578 S * 5/2003 Johnson ..... D2/879
7,096,511 B2 * 8/2006 Cohen ..... A41D 15/00 2/206
7,152,252 B2 * 12/2006 Gellis ..... A41D 13/11 2/206
7,337,475 B1 * 3/2008 Wood ..... A42B 1/067 2/202
D595,483 S * 7/2009 Behling ..... D2/882
D603,145 S * 11/2009 Erby ..... D2/882
7,836,522 B2 * 11/2010 Blecha ..... A42B 1/041 2/174
D643,186 S * 8/2011 Greenspan ..... D2/872
8,621,668 B1 * 1/2014 Nolz ..... A42B 5/00 2/171.4
2003/0074717 A1 * 4/2003 Robinson ..... A42B 1/045 2/204
2005/0034215 A1 * 2/2005 Harrison ..... A42B 1/008 2/207
2006/0005297 A1 * 1/2006 Blecha ..... A42B 1/041 2/207
2006/0010567 A1 * 1/2006 Vazquez ..... A41D 23/00 2/175.1
2006/0048277 A1 * 3/2006 Yeadon ..... A42B 1/041 2/204
2006/0212995 A1 * 9/2006 Collins ..... A42B 1/066 2/175.6
2007/0050887 A1 * 3/2007 Leguenec ..... A42B 1/041 2/171
2008/0250538 A1 * 10/2008 Saladino ..... A42B 1/247 2/10
2008/0307561 A1 * 12/2008 Grey ..... A42B 1/041 2/202
2011/0179540 A1 * 7/2011 Sutton ..... A41D 13/1107 2/9
2011/0247126 A1 * 10/2011 White ..... A42B 1/041 2/207
2012/0278971 A1 * 11/2012 Kordon ..... A42B 1/062 2/195.1
2014/0202469 A1 * 7/2014 Smaller ..... A62B 18/025 128/863
2014/0208482 A1 * 7/2014 Asbury ..... A42B 1/041 2/172
2015/0000006 A1 * 1/2015 Anderson ..... A45D 8/00 2/173
2018/0184729 A1 * 7/2018 Rybak ..... A41B 7/00
2019/0116905 A1 * 4/2019 Rybak ..... A42B 1/006

* cited by examiner

CONVERTIBLE HEADWEAR

TECHNICAL FIELD OF THE INVENTION

The invention disclosed herein relates to a convertible multifunctional headwear.

SUMMARY OF THE INVENTION

The invention disclosed herein relates to a convertible multifunctional headwear. Specifically, the invention disclosed herein is directed at a hat that is convertible into a face mask. In an embodiment, the present invention is directed at a convertible headwear, comprising a kerchief, a headband, and a visor, wherein the kerchief, the headband, and the visor are irremovable interconnected to form a hat that is convertible into a face mask, wherein the headband comprises one terminal end and one other terminal end, wherein each of the one terminal end and the one other terminal end comprises at least one fastening element, wherein the at least one fastening element of the first terminal end is configured to removably connect to the at least one fastening element of the one other terminal end, wherein the visor is irremovably connected to the kerchief, and wherein the headband is irremovably connected to the kerchief.

DETAILED DESCRIPTION

The invention disclosed herein relates to a convertible multifunctional headwear. Specifically, the invention disclosed herein is directed at a hat that is convertible into a face mask.

Universality of useful articles of manufacture steadily prevails in every day life. Pants that are convertible into shorts. Jackets that are convertible into vests, sleeves that are convertible into scarfs or belts, and the like. As we find ourselves to be mobile in our daily life, dealing with less items that are serve multiple purpose becomes increasingly important.

The invention disclosed herein is one of the examples of a universal headwear that is easily convertible from a hat into a face mask and vice versa.

Turning to the drawings that fully illustrate the functionality, utility, novelty, and usefulness of the invention disclosed in the present patent application.

Figure 1:
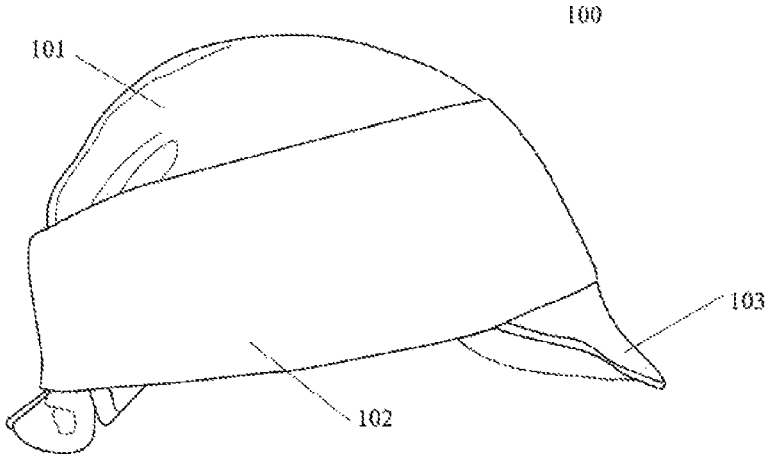
FIG. 1 is a right-side view of the convertible headwear in its hat configuration, according to an example of the present invention.

FIG. 1 illustrates a [side] view of the convertible headwear in accordance with the embodiment of the invention disclosed herein. For simplicity, the convertible headwear disclosed herein is called a convertible hat. The shown convertible headwear 100 comprises three main elements: kerchief 101, headband 102 and visor 103.

Figure 2:
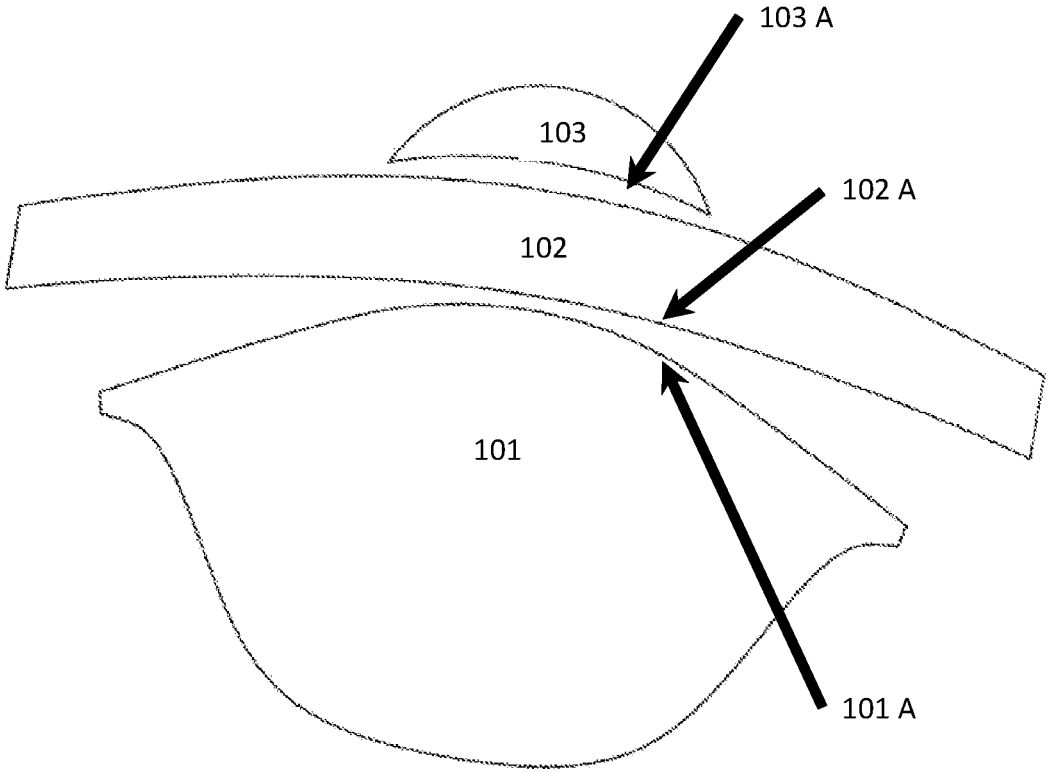
FIG. 2 illustrates essential elements of the convertible headwear in its hat configuration, according to an example of the present invention.

FIG. 2 illustrates kerchief 101, headband 102, and visor 103 prior to its assembly into convertible headwear 100. The kerchief 101 having a curved edge 101A for attachment to the headband 102, the headband also having a curved edge 102A for attachment to the kerchief 101. The attachment of the kerchief edge 101A and the headband edge 102A results in a curved connection. This curved connection provides for a smooth surface for covering a user's face while the headwear is used as a mask. A person ordinarily skilled in the art will understand that the shown configuration of each element shown in FIG. 2 is presented in one of its embodiments and that configuration of each shown element of convertible headwear 100 may vary depending on the intended style and size of convertible headwear 100.

Although not shown, each of the terminal ends of headband 102 may be equipped with fastening elements, where the fastening elements can be buttons, snaps, Velcro, zippers, strips of hook-and-loop material, and the like. It should be noted that other fasteners or fastening elements may be used without departing from the spirit of the invention.

A person ordinarily skilled in the art will also understand that a configuration of shown visor 103 may vary. For example, visor 103 may be manufactured as flexible, e.g., capable of being bent or having a sturdy insert planted within to maintain the shape of visor 103 unchangeable.

A person ordinarily skilled in the art will also understand that width of the headband 102 may vary depending on the type, size, and style of convertible headwear 100.

It is to be understood that kerchief 101 and headband 102 may be manufactured from any suitable material, such as a laminated integrated sun-blocking multilayered sheet consisting of textile and synthetic resin film ensuring a light-blocking effect. The textile may be made of a natural fiber such as cotton and silk or a regenerated fiber such as rayon, or may be a textile made by weaving or knitting a synthetic multifilament fiber. It is preferable that the textile is made from the synthetic multifilament fiber excellent in durability and processability.

In other embodiment, each of kerchief 101 and headband 102 may be manufactured from a breathable and permeable material.

In the preferred embodiment, visor 103 and headband 102 is irremovably attached to one of the edges of kerchief 101.

In one illustrative embodiment of a method assembly of convertible headwear 100, visor 103 is attached, for example, by stitching, to kerchief 101. A median line of headband 102 is aligned with a median line of kerchief 101. Kerchief 101 is folded in such a way that external surfaces of the kerchief 101 are facing inward. Slanted notches along with marked lines on the both sides of kerchief 101. Kerchief 101 is formed into a spherical shape with an outer edge of kerchief 101 being stitched up approximately ¼" from the edge. Headband 102 is stitched up onto kerchief 101 such that the terminal ends of headband 102 are enabled to be interconnected and secured by fastening means to form convertible headwear 100.

Figure 3:
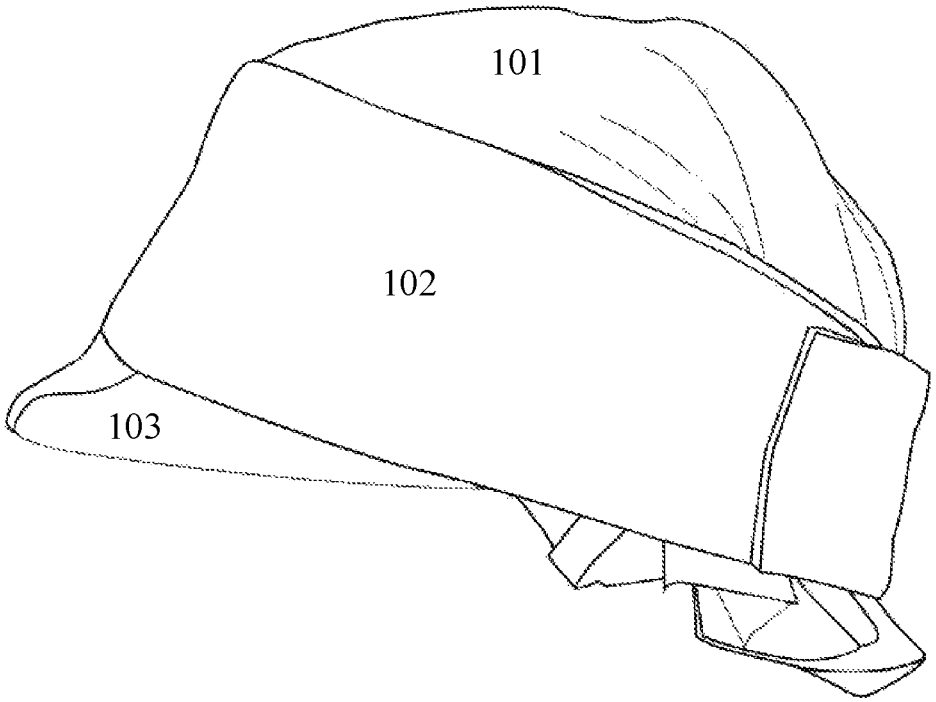
FIG. 3 illustrates a rear-left-side view of the convertible headwear in its hat configuration, according to an example of the present invention.
Figure 4:
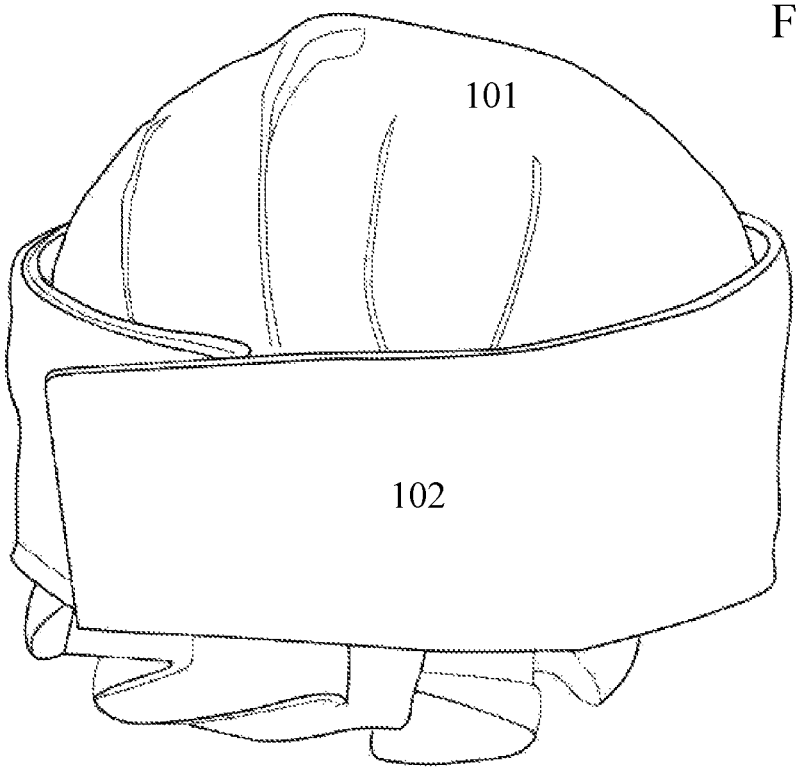
FIG. 4 illustrates a rear view of the convertible headwear in its hat configuration, according to an example of the present invention.

FIG. 3 illustrates a rear left side of convertible headwear 100 and FIG. 4 illustrates rear right side of convertible headwear 100.

As may be readily appreciated from the views illustrated by FIGS. 3-4, when a wearer of convertible headwear 100 uses it as a hat, headband 102 serves as a band encircling the skull of a wearer, with terminal ends of headband 102 are interconnected on the back of the wearer's head.

The main advantage of convertible headwear 100 is it utility to be converted into a face mask. The purpose of a face mask may be more than singular. For example, when a wearer of convertible headwear 100 has the need to protect the wearer from noxious fumes, from allergenic or microbial particles, or to protect the wearer's face from insects.

In order to convert convertible headwear 100 from its "hat" configuration into a "face mask" configuration, a wearer simply unlocks terminal ends of headband 102 and repositioning the convertible headwear 100 such that visor 103 covers the wearer's nose and parts of the wearer's cheeks while inner cavity of kerchief 101 serves as a cover for the wearer's lower half of the face, including cheeks, mouth, chin, and neck with headband 102 encircling the wearer's face from both sides of the face in the jaw area and around the wearer's neck with terminal ends of headband interconnected on the back of wear's head.

Figure 5:
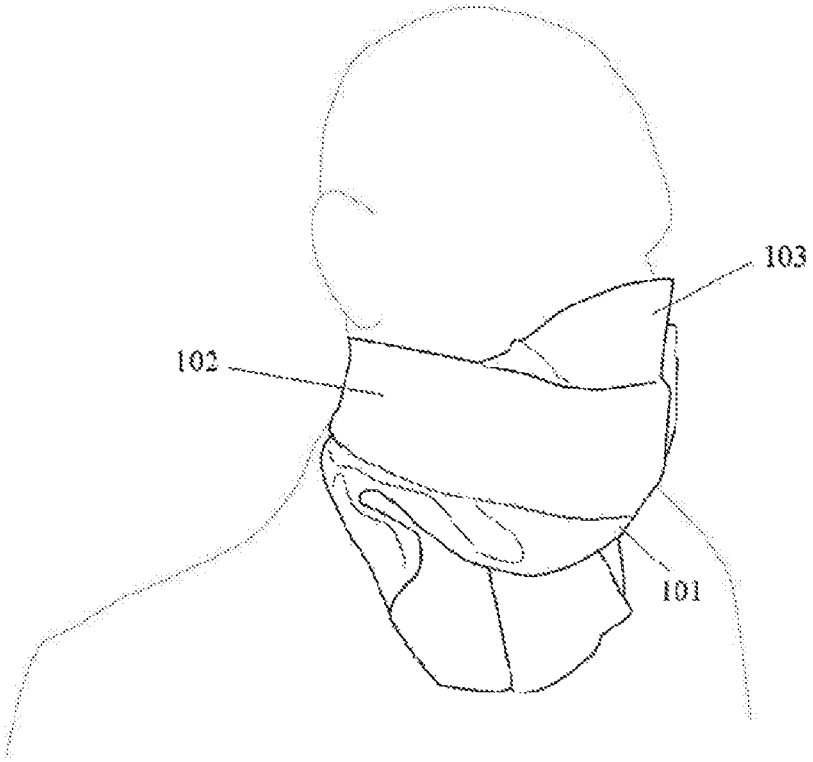
FIG. 5 illustrates a right-hand-side view of the convertible headwear in its face mask configuration, according to an example of the present invention.

FIG. 5 illustrates a right-hand side view of convertible headwear 100 presented in its "face mask" configuration. As may be appreciated, the novel configuration of all three elements of convertible headwear 100 enables its conversion from the "hat" configuration into the "face mask" configuration without any need to detach or re-assemble convertible headwear 100.

It is to be understood that a person ordinarily skilled in the art that described configuration is provided as illustrative embodiment and that the invention disclosed herein may be configured differently. For example, the difference in the length of the charging transfer cable may be applicable for only one end of the jumper cable apparatus, respective of the midpoint of the jumper cable apparatus.

The foregoing descriptions and drawings of the invention are explanatory and illustrative only, and various changes in shapes, sizes and arrangement of parts as well as certain details of the illustrated construction may be made within the scope of the appended claims without departing from the true spirit of the invention.

That is claimed is:

1. A convertible headwear, comprising:
a kerchief:
a headband; and
a visor, wherein prior to assembly of the headband:
the kerchief having a first curved edge;
the headband having a second curved edge and a third curved edge opposite the second curved edge; and
the visor having a fourth curved edge, wherein when assembled the kerchief and the headband are interconnected at the first and second curved edges to form a curved connection that is pucker free for at least a portion thereof over the visor, and wherein the visor and the headband are interconnected at the third and fourth curved edges to form a hat that is convertible into a face mask such that the curved connection between the headband and the kerchief form a peak for when used as a mask.

2. The convertible headwear of claim 1, wherein the headband comprises one terminal end and one other terminal end.

3. The convertible headwear of claim 2, wherein each of the one terminal end and the one other terminal end comprises at least one fastening element.

4. The convertible headwear of claim 3, wherein the at least one fastening element of the first terminal end is configured to removably connect to the at least one fastening element of the one other terminal end.

5. The convertible headwear of claim 1, wherein a curvature of the third curved edges is different than a curvature of the fourth curved edge, the visor is connected to the kerchief such that a curved connection therebetween is pucker free for at least a portion thereof.

6. The convertible headwear of claim 1, wherein a curvature of the first curved edge is different than a curvature of the second curved edge.

7. The convertible headwear of claim 1, wherein a curvature of the second curved edge is different than a curvature of the third curved edge.

8. The convertible headwear of claim 1, wherein a curvature of the first, second, third, and fourth curved edges are different from each other.

9. The convertible headwear of claim 1, wherein the kerchief has a fifth curvature edge opposite the first curved edge.

10. The convertible headwear of claim 9, wherein the fifth edge has a curvature comprising at least one compound curve.

11. The convertible headwear of claim 1, wherein the first and fifth edges have a curvature such that the kerchief has a convex shape.

12. A convertible headwear, comprising:
a kerchief;
a headband having removably connectable terminal edges; and
a visor, wherein prior to assembly of the headband:
the kerchief having a first curved edge;
the headband having a second curved edge and a third curved edge opposite the second curved edge; and
the visor having a fourth curved edge, wherein when assembled the kerchief and the headband are interconnected at the first and second curved edges to form a curved connection that is pucker free for at least a portion thereof over the visor, and wherein the visor and the headband are interconnected at the third and fourth curved edges to form a hat that is convertible into a face mask such that the curved connection between the headband and the kerchief form a peak for when used as a mask, and wherein a curvature of the first curved edge is different than a curvature of the second curved edge, a curvature of the second curved edge is different than a curvature of the third curved edge, wherein the kerchief has a fifth curvature edge opposite the first curved edge, the first and fifth edges have a curvature such that the kerchief has a convex shape.

* * * * *